United States Patent [19]

Yamaguchi et al.

[11] Patent Number: 5,038,007

[45] Date of Patent: Aug. 6, 1991

[54] SWITCH

[75] Inventors: Noboru Yamaguchi; Naokatu Okamura, both of Aichi, Japan

[73] Assignee: Kabushiki Kaisha Tokai Rika Denki Seisakusho, Aichi, Japan

[21] Appl. No.: 546,751

[22] Filed: Jul. 2, 1990

[51] Int. Cl.[5] ..... H01H 3/16; H01H 27/06

[52] U.S. Cl. ..... 200/61.64

[58] Field of Search ..... 200/61.62, 61.64–61.68, 200/43.08

[56] References Cited

U.S. PATENT DOCUMENTS 3,917,919 11/1975 Tahara ..... 200/43.08

4,580,019 4/1986 Takahashi ..... 200/43.08

*Primary Examiner*—J. R. Scott

*Attorney, Agent, or Firm*—Finnegan, Henderson, Farabow, Garrett and Dunner

[57] ABSTRACT

A switch device comprises a rotary shaft rotatably provided in a cylindrical holder in such a manner that the rotary shaft is rotated by a manual operation, a switch holder detachably attached to the cylindrical holder a switch provided in the switch holder, a cover detachably attached to the switch holder, and a switch arm rotatably supported to the cover so as to connect the switch arm to the opposite end of the rotary shaft, the switch being operated by rotating the switch arm in conjuction with the rotation of the rotary shaft. Due to the construction, the device as a whole can be reduced in size. Therefore, the device can be installed in a limited small space.

8 Claims, 2 Drawing Sheets

SWITCH

BACKGROUND OF THE PRESENT INVENTION

The present invention relates to a switch device and more particularly to a switch device provided with a switch operated in response to the rotation of a rotary shaft of a key rotor, or the like, which is provided in a holder.

The present assignee filed a Japanese Utility Model Application No. Sho. 59-133748 as a conventional switch device related to the device of the present invention. In this conventional device, a switch portion is provided at a back portion of a holder so as to uniformly surround an entire outer circumference surface of a back end portion of a rotor which is rotated by a key.

Another conventional device is proposed in the Japanese Utility Model Unexamined Publication No. Sho. 62-47674 in which a burglar-cancel member is rotatably provided at a back end of a key rotor so as to pivot along an outer circumference of a holder and a micro-switch is provided so as to confront with the burglar-cancel member.

In the former conventional device, since the switch portion is provided at the back end portion of a key rotor so as to surround the entire outer circumference of the back end of the key rotor, the diameter of the switch portion becomes large in length. Also, in the latter conventional device, since the burglar-cancel member is provided at the outer circumference of the holder, it is necessary to have a large space around the outer circumference portion of the holder. For this reason, any of the conventional devices noted above becomes large in size. As a result, the above conventional devices suffer from the problem that they cannot cope with the case where there is a restricted spatial problem when trying to fix the device in place.

SUMMARY OF THE INVENTION

It is, therefore, an object of the present invention to provide a switch device which can cope with a limitation of the portion where the switch device should be fixed, by reducing an occupied space of the switch device, especially that around the holder.

In order to attain this and other objects, a switch device of the present invention comprises: a cylindrical holder; a rotary shaft supported to the cylindrical holder, the rotary shaft having a first end portion and a second end portion, the first and second end portions being rotatable by a manual operation; a switch holder detachably attached to the cylindrical holder at a side defined by the second end portion; a switch provided in the switch holder; a cover detachably attached to the switch holder; and a switch arm rotatably supported to the cover and connected to the second end portion, the switch being operated by rotating the rotary shaft together with the switch arm.

According to the arrangement of the present invention, it is possible to limit the space provided with a switch portion to a part of a rear end portion of the rotary shaft to thereby extremely reduce the occupied space of the switch holder around the rotary shaft. Therefore, it is possible to make the device small in size in comparison with the conventional devices, to thereby cope with the limitation of the portion where the device should be fixed.

In addition, the present invention can be applied to a trunk-lid-opener, a door-key, or the like.

BRIEF DESCRIPTION OF THE DRAWINGS

In the accompanying drawings all of which show an embodiment of the present invention.

DETAILED DESCRIPTION OF THE PREFERRED EMBODIMENTS

The switch device according to an embodiment of the present invention will be described with reference to the accompanying drawings. The embodiment is adapted as a trunk-lid-opener.

Figure 1:
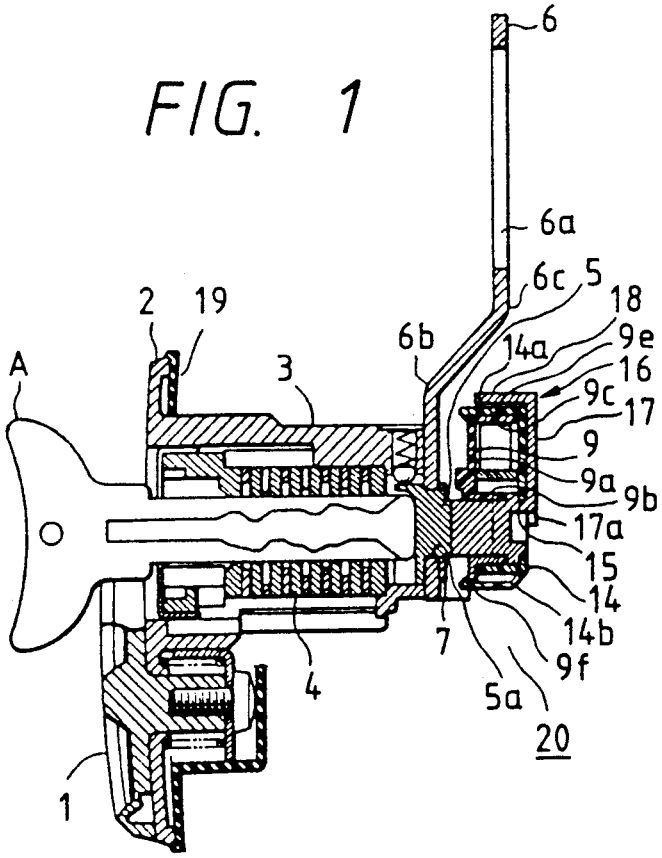
FIG. 1 is a cross sectional view of the switch device according to the embodiment of the present invention.
Figure 3:
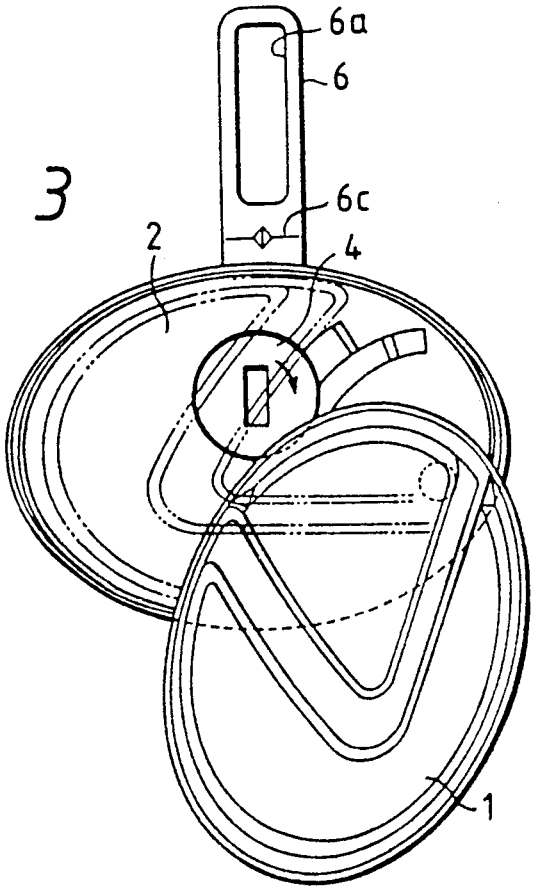
FIG. 3 is a frontal view of the switch device.
Figure 4:
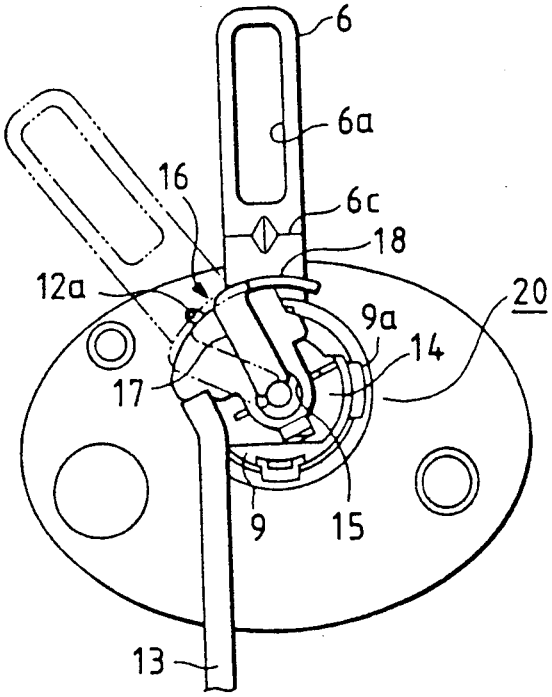
FIG. 4 is a rear view of the switch device.
Figure 5:
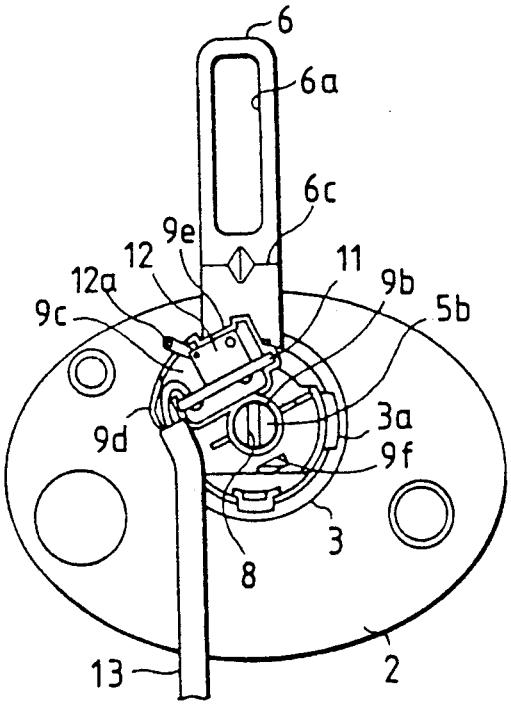
FIG. 5 is a rear view from which a cover has been removed for clarification purposes.

Referring first to FIG. 3, a plate 2 which is die-cast of zinc is provided at a front portion thereof with a plate cover 1 which is capable of opening and closing the plate. In a central portion of the plate 2, a cylindrical holder 3 is formed integrally with the plate 2 to extend backwardly from the plate 2 as best shown in FIG. 1. The holder 3 is provided at its inner surface with a key rotor 4 which functions as a rotary shaft which is rotatable when a key A is inserted from one side, i.e. a front side of the key rotor 4. A lever 6 is inserted into a shaft 5 of the key rotor 4 and is prevented from falling apart from the key rotor 4 by an E-ring 7 engaged with an annular groove 5*a* provided on an outer periphery of the shaft 5. The lever 6 extends upwardly from the shaft 5 of the key rotor 4 and rotates together with the key rotor 4. The lever 6 is formed at its tip end with a rectangular slot 6*a*. The lever 6 is backwardly bent at a first portion 6*b* at about 30 degrees and forwardly bent at a second portion 6*c* at about 30 degrees as shown in FIG. 1. As shown in FIG. 5, a connection groove 8 is formed at a rear end face 5*b* of the shaft 5.

Figure 2:
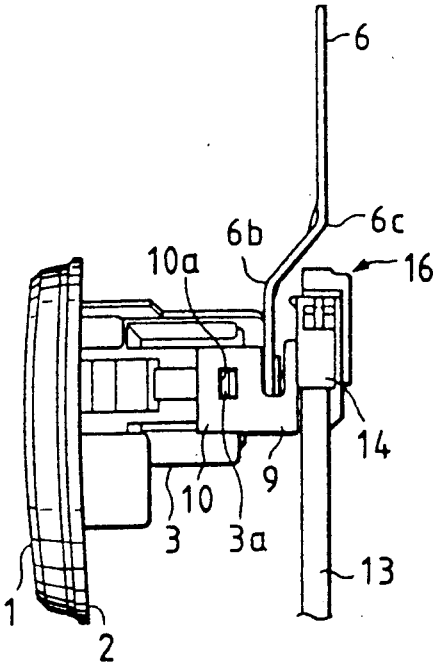
FIG. 2 is a side view of the switch device.

As shown in FIG. 2, a switch holder 9 made of plastic is detachably attached to the holder 3 in such a manner that claw portions 3*a* protruded from an outer surface of the holder 3 are engaged with engagement holes 10 a provided on a leg portion 10 of the switch holder 9, respectively. In a central portion of a base portion 9*a* of the switch holder 9, a cylindrical portion 9*b* extending backwardly from the base portion 9*a* is provided in such a manner that a tip end of the shaft 5 of the rotor 4 is inserted into the cylindrical portion 9*b* to allow the free rotation of the axial portion 5. A switch case having a box-like configuration opened backwardly is defined by a switch case portion 9*c* and the base portion 9*a* which are integrally formed with the cylindrical portion 9*b*. The switch case defines only the space just above the shaft 5. Namely the switch case extends substantially in the same direction as a direction in which the lever 6 extends. As best shown in FIG. 5, a micro-switch 12 mounted on a printed circuit board 11 is installed in the switch case defined by the switch case portion 9*c* and the base portion 9*a*. A lead wire 13 extending from the substrate 11 extends from a groove 9*d* provided on the switch case portion 9*c*. Engagement portions 9*e* and 9*f* are provided on the switch case portion 9*c* and the base portion 9*a*, respectively, in such a manner that the engagement portions 9e and 9f are located at diametrically opposite sides of the cylindrical portion 9b to confront with each other. The engagement portions 9e and 9f are engaged with claw portions 14a and 14b of a cover 14 so as to attach the cover 14 onto the switch holder 9.

Figure 6:
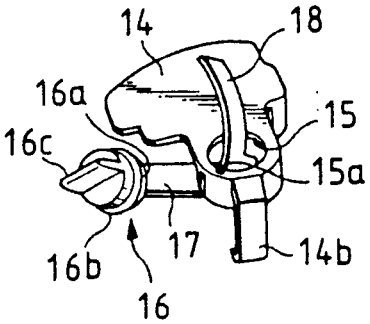
FIGS. 6 and 7 are perspective views showing a process of assembling a switch arm.

The cover 14 is formed with a circular hole 15 at a position where the cylindrical portion 9b faces when the cover 14 is attached onto the switch holder 9. The circular hole 15 is formed with an escape groove 15a as shown in FIG. 6. A metal switch arm 16 is rotatably supported to the circular hole 15. The metal arm 16 is provided with an shaft portion 16a having an annular convex portion 16b and a claw portion 16c. The convex portion 16b is uniformly protruded from the outer periphery of the shaft portion 16a. The convex portion 16b is fitted to the inner surface of the cover 14 when assembled, so that the switch arm is prevented from falling apart from the circular hole 15. The claw portion 16c is provided on one end of the shaft portion 16a. The claw portion 16c is engaged with the connection groove 8 of the shaft 5 of the key rotor 4 when assembled, so that the rotation of the key rotor 4 is transmitted to the switch arm 16. The switch arm is further provided with an arm portion 17 and an activation member 18. The arm portion 17 extends from the other end of the shaft portion 16a. The arm portion 17 is positioned along a back surface of the cover 14. The activation member 18 extends from the end of the arm portion 17 opposite to the shaft portion 16a and has a semi-arcuate configuration. The activation member 18 is designed so as to be moved slidingly along a side surface of the cover 14 and axially with respect to the shaft portion 16a. Reference numeral 17a designates a notch provided at a proximal end of the arm portion 17, which notch is utilized for assembling the switch arm 16 relative to the cover 14. Reference numeral 19 designates a seal member disposed on the back side of the plate 2, which is made of rubber, or the like.

The operation of the embodiment thus described above will be hereinafter described.

Figure 7:
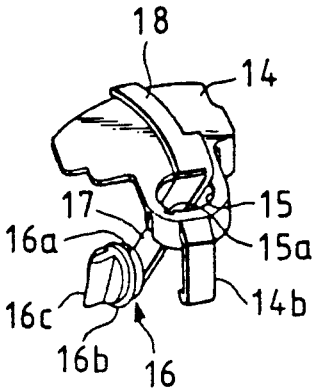

The switch holder 9 with the micro-switch 12 installed therein, the cover 14 and switch arm 16 are assembled in advance as a sub-assembly. As shown in FIGS. 6 and 7, the activation member 18 and the arm portion 17 are successively inserted into the circular hole 15 of the cover 14 from the inner side of the cover 14 with use of the escape groove 15a. Further, with use of the notch 17a, the shaft portion 16a of the switch arm 16 is inserted into the hole 15. The activation member 18 is thus disposed along the outer periphery of the cover 14. In that state, the claw portions 14a and 14b of the cover 14 are engaged with the engagement portions 9e and 9f of the switch holder 9, thus providing the sub-assembly, i.e. a switch assembly 20 as a unit construction. The switch assembly 20 is attached to the holder 3 in such a manner that the claw portions 3a of the holder 3 is inserted into and engaged with the engagement holes 10a of the leg portion 10. In this stage, the claw portion 16c of the switch arm 16 is engaged with the connection groove 8 of the key rotor 4 so as to transmit the rotation of the key rotor 4 to the switch arm 16. With such an arrangement, due to the operation that the key A is inserted into the key rotor 4 as shown in FIG. 1 and rotated in the clockwise direction shown by an arrow B of FIG. 3, the switch arm 16 is rotated in the same direction as that of the key 4, so that an activate member 12a of the micro-switch 12 is depressed by an inner circumferential portion of the activation member 18, thus effecting the ON operation.

As is apparent from the above explanation, in the embodiment of the present invention, since the micro-switch 12 is located at a side where the lever 6 is provided so that the micro-switch 12 is confronted with a part of the periphery of the shaft 5 of the key rotor 4, the switch holder 9 can be effectively physically limited in such a manner that the switch holder 9 is protruded from the holder 3 in only one direction, i.e. the direction in which lever 6 extends. Therefore, the device as a whole can be reduced in size. In other words, the occupied area by the micro-switch or the like around the holder can be extremely reduced. For that reason, it is easier to cope with a limitation of an area where the switch device should be installed, in comparison with any conventional devices wherein a switch surrounds the whole outer circumference, a micro-switch is provided on a base plate so as to confront with the burglar-cancel member rotated together with a key rotor, and so on. It is, therefore, possible to effectively apply the present invention to the case where the switch device must be installed in a limited small space.

What is claimed is:

1. A switch device comprising:

a cylindrical holder;

a rotary shaft rotatable in said cylindrical holder, said rotary shaft having first and second ends, said rotary shaft being rotatable by a manual operation, and said second end having a connection groove formed therein;

a switch holder removably attached to said cylindrical holder, said switch holder having a base portion, a cylindrical member extending from said base portion for supporting said second end of said rotary shaft and a wall member extending from said cylindrical member for defining a switch case;

a switch mounted on a printed circuit board in said switch case;

a cover having a circular hole removably attached to said switch holder; and a switch arm rotatably supported to said cover, said switch arm having a convex portion at one end fitted to said hole in said cover and a claw portion at the opposite end connected to said connection groove of said second end of said rotary shaft, said switch being operated by rotating said rotary shaft together with said switch arm.

2. The device according to claim 1, wherein said switch holder includes a leg portion extending from said base portion in a direction opposed to a direction in which said cylindrical member extends, said leg portion having engagement holes formed therein.

3. The device according to claim 2, wherein said cylindrical holder includes claw portions at one end for engaging said engagement holes to detachably attach said switch holder to said cylindrical holder.

4. The device according to claim 1, wherein said switch arm includes a shaft portion extending from said convex portion, an arm portion extending from said shaft portion and an activation member integrally formed with said arm portion, said activation member being rotatable with said switch arm for operating said switch.

5. The device according to claim 4, wherein said arm portion includes a notch where it extends from said shaft portion for fitting said switch arm to said cover.

6. The device according to claim 1, wherein said base portion and said wall member include engagement portions formed therein.

7. The device according to claim 6, wherein said cover includes claw portions to engage said engagement portions to detachably attach said cover to said switch holder.

8. The device according to claim 7, wherein said switch holder, including said switch, and said cover including said switch arm, form a separate sub-assembly.

* * * * *

UNITED STATES PATENT AND TRADEMARK OFFICE

CERTIFICATE OF CORRECTION

PATENT NO. : 5,038,007

DATED : August 06, 1991

INVENTOR(S) : Noboru Yamaguchi et al.

It is certified that error appears in the above-identified patent and that said Letters Patent is hereby corrected as shown below:

Title Page:

Abstract, line 10, change "conjuction" to --conjunction--.

Claim 8, column 6, line 4, after "holder" delete ",".

Title page, please add the following:

[30] Foreign Application Priority Data July 4, 1989

[JP] Japan...1-78853.

Signed and Sealed this

Twenty-third Day of March, 1993

*Attest:*

STEPHEN G. KUNIN

*Attesting Officer*

*Acting Commissioner of Patents and Trademarks*